US006990312B1

(12) United States Patent
Gioscia et al.

(10) Patent No.: US 6,990,312 B1
(45) Date of Patent: Jan. 24, 2006

(54) METHOD AND SYSTEM FOR INTERACTIVE DIGITAL RADIO BROADCASTING AND MUSIC DISTRIBUTION

(75) Inventors: Richard Gioscia, Mahwah, NJ (US); Yumi Sonoda, Los Altos, CA (US); Jan-Christoph Zoels, Brooklyn, NY (US)

(73) Assignees: Sony Corporation, (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/197,506

(22) Filed: Nov. 23, 1998

(51) Int. Cl.
*H04H 7/00* (2006.01)

(52) U.S. Cl. ..... 455/3.06; 455/3.01; 455/2.01; 379/101.01; 379/102.03

(58) Field of Classification Search ..... 455/45, 455/66.1, 412.1, 412.2, 38.4, 514, 566, 67.7, 455/154.1, 575.1, 3.06, 3.01, 41.2, 569.2, 455/575.9, 70, 69, 442.1, 442.2, 456.5, 550.1, 455/561, 566.5, 158.5, 156.1, 166.1, 186.1, 455/67.1; 379/59, 93.12, 93.15, 101.01, 379/102.01, 102.02, 102.03; 725/61, 62, 725/63, 73, 86, 32, 143, 95, 115, 145, 87; 345/327; 348/6, 7, 10, 3, 14.02, 211.2, 385.1, 348/389.1; 370/71, 73, 76, 77, 110.1, 110.4, 370/111, 527, 67.1, 496, 522, 102.01, 102.02, 370/90.01, 93.17, 93.19, 901, 902; 369/7; 707/501; 705/26, 27, 51, 57; 381/2, 3, 4, 381/77; 84/609

See application file for complete search history.

(56) References Cited

U.S. PATENT DOCUMENTS 3,696,297 A * 10/1972 Otero ..... 455/2.01
5,063,610 A * 11/1991 Alwadish ..... 455/45
5,119,503 A * 6/1992 Mankovitz ..... 455/45
5,214,792 A * 5/1993 Alwadish ..... 455/45
5,239,540 A * 8/1993 Rovira et al. ..... 370/59
5,345,430 A * 9/1994 Moe ..... 369/7
5,491,838 A * 2/1996 Takahisa et al. ..... 455/3.06
5,564,073 A 10/1996 Takahisa ..... 455/66
5,577,266 A * 11/1996 Takahisa et al. ..... 455/66
5,579,537 A * 11/1996 Takahisa ..... 455/66
5,594,779 A 1/1997 Goodman ..... 379/59
5,596,373 A * 1/1997 White et al. ..... 348/569
5,694,162 A * 12/1997 Freeny, Jr. ..... 348/12
5,694,455 A * 12/1997 Goodman ..... 379/59
5,703,795 A * 12/1997 Mankovitz ..... 364/514

(Continued)

FOREIGN PATENT DOCUMENTS

EP 0 797 322 9/1997

(Continued)

OTHER PUBLICATIONS

Written Opinion in corresponding PCT Application.

*Primary Examiner*—Edward F. Urban
*Assistant Examiner*—Charles Chow
(74) *Attorney, Agent, or Firm*—Rader, Fishman & Grauer, PLLC; Ronald P. Kananen

(57) ABSTRACT

A method and system for providing easier listener access to information about musical works and other audio programming broadcast by a digital radio station includes broadcasting contextual information about the audio programming along with the audio programming. A receiver separates the audio and data signals giving the listener access to the broadcast content and the associated information about that content. The system may also store the contextual information about the programming for later reference, for example ordering a recording of the programming.

23 Claims, 2 Drawing Sheets

U.S. PATENT DOCUMENTS 5,732,216 A * 3/1998 Logan et al. ..... 395/200.33
5,742,893 A 4/1998 Frank ..... 455/66
5,918,213 A * 6/1999 Bernard et al. ..... 705/26
6,199,076 B1 * 3/2001 Logan et al. ..... 707/501
RE37,131 E * 4/2001 Mankovitz ..... 455/66.1
6,212,359 B1 * 4/2001 Knox ..... 455/3.1
6,314,573 B1 * 11/2001 Gordon et al. ..... 725/61
6,516,466 B1 * 2/2003 Jackson ..... 725/62

FOREIGN PATENT DOCUMENTS

EP 0 843 429 5/1998

* cited by examiner

METHOD AND SYSTEM FOR INTERACTIVE DIGITAL RADIO BROADCASTING AND MUSIC DISTRIBUTION

FIELD OF THE INVENTION

The present invention relates to the fields of interactive music broadcasting and commercial music distribution. More particularly, the present invention relates to a method and system for allowing a listener to designate and store information about music, such as title and artist, as the music is received from a broadcast service provider.

BACKGROUND OF THE INVENTION

Radio broadcasting is an important source of news, information and entertainment for most people around the world. As a result, advertisers are willing to pay substantial sums of money to promote products and services on the radio. This source of revenue allows radio stations to provide programming which will draw the listeners desired by advertisers.

A particular radio station, depending on its format, may broadcast a specific type or types of music, talk shows, news, locally relevant information or a combination of any or all of these. Listeners will identify those stations that provide the type of programming desired and access those stations.

Radio receivers used by listeners to hear radio broadcasts are of at least three general types: stationary units, automobile units and portable personal units. A stationary radio receiver may be incorporated into a home stereo system or may be a stand-alone unit plugged into an electrical wall outlet. Radio receivers are also found in almost all automobile sound systems. Finally, radio receivers may be portable battery-powered units that can be carried with or worn by the listener.

In addition to promoting the products of paid advertisers, radio broadcasts of music also promote the sale of musical works. Radio broadcasting is a principal showcase for debuting newly released musical works. Listeners are frequently first alerted to newly-released works of their favorite artists by hearing those works played on the radio. Additionally, listeners often come to appreciate the work of a new or established artist by hearing that work over the radio.

After becoming acquainted with a musical work in this manner, a listener typically goes to a music store to buy a recording of the music. This requires that the user be informed of the title and artist by the radio broadcast. If the announcer does not state the artist or title of a musical work being broadcast, or if the listener misses that part of the broadcast, the listener may have difficulty identifying a recording of the work at a music store. Additionally, a listener may have an interest in obtaining more information about a musical work or artist than is generally provided by a radio announcer.

Consequently, there is a need in the art for a method and system for providing listeners with appropriate information about musical and other audio programming in a radio broadcast. Moreover, there is an additional need in the art for providing listeners with a ready and easy means of storing such information until it is wanted, for example, to identify a recording to be purchased.

Additionally, a listener may have some interest in a particular musical work heard on the radio, but may not yet have made a decision to purchase a recording of the work. Typically, in such circumstances, the listener must wait until the radio station has, in the regular course of its formatting, played the work enough times for the listener to decide whether he or she wishes to purchase a recording of the work.

Consequently, there is a need in art for a method and system which allows a radio listener to achieve greater familiarity with an identified work without having to wait for the radio station to replay the work. There is also a need for a method and system which more easily allows a user to purchase a recording of an identified musical work which has been heard in a radio broadcast.

SUMMARY OF THE INVENTION

It is an object of the present invention to meet the above-described needs and others. Specifically, it is an object of the present invention to provide a method and system of providing listeners with contextual information about musical works and other audio programming contained in a radio broadcast. It is a further object of the invention to provide listeners with a ready and easy means of recording such contextual information for later reference.

It is a further object of the present invention to provide a method and system with which a radio listener can quickly become more familiar with a new musical work in which the listener has some interest. Finally, it is an object of the present invention to provide a method and system for facilitating the purchase of a recording of a musical work that a listener has been introduced to by a radio broadcast.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve these stated and other objects, the present invention may be embodied and described as a method of providing listeners with information about audio programming being digitally broadcast. The method includes combining a data signal carrying contextual information about the audio programming with an audio signal carrying the audio programming, and broadcasting the combined data and audio signals as a digital radio signal.

Listeners with digital radio receiver then complete the method by receiving the combined data and audio signals with a receiver; separating the data and audio signals; and transducing the audio signal into audible sound. The method also preferably includes displaying the contextual information of the data signal on a display device of the receiver.

The present invention also encompasses a receiver for receiving a broadcast signal which is an audio signal and a data signal combined, the data signal containing contextual information about audio programming carried by the audio signal. The receiver includes: a transceiver for receiving the broadcast signal; a signal processor for separating the audio and data signals; and an audio output device for outputting the audio signal.

Preferably, the receiver also has a display device for displaying the contextual information of the data signal. A user input device may be provided for controlling the display of the contextual information on the display device.

A memory cartridge is preferably included in the receiver for storing at least a portion of the contextual information of the data signal. This cartridge is preferably a removable memory cartridge. The user input device is also used for controlling the storage of contextual information in the memory cartridge and accessing stored contextual information in the memory cartridge.

The receiver also preferably includes a connection between the processor and a service provider over which at least a portion of the contextual information may be transmitted to identify particular audio programming to the service provider. This connection may be wireless. The user input device is again used for controlling the transmission of contextual information over the connection to the service provider and for generating requests to be transmitted to the service provider to purchase a recording of the particular audio programming.

The recording of the audio programming purchased may shipped to the listener, or may be transmitted electronically by the service provider to the processor. If the recording is received electronically, the receiver preferably includes a memory device for storing the audio programming and any additional contextual information received over the connection from the service provider.

The present invention also encompasses a method for receiving a broadcast signal which is an audio signal and a data signal combined, the data signal containing contextual information about audio programming carried by the audio signal. This method includes the steps of receiving the broadcast signal with a transceiver; separating the audio and data signals with a signal processor; and outputting the audio signal.

The method may also include displaying the contextual information of the data signal with a display device; controlling the display of the contextual information on the display device with a user input device; and storing at least a portion of the contextual information of the data signal in a removeable memory cartridge.

The present method may also include purchasing a recording of the audio programming by transmitting at least a portion of the contextual information to a service provider to identify the audio programming. This step may be performed wirelessly.

BRIEF DESCRIPTION OF THE DRAWINGS

The accompanying drawings illustrate the present invention and are a part of the specification. Together with the following description, the drawings demonstrate and explain the principles of the present invention.

DETAILED DESCRIPTION OF THE PREFERRED EMBODIMENTS

Using the drawings, the preferred embodiments of the present invention will now be explained.

Figure 1:
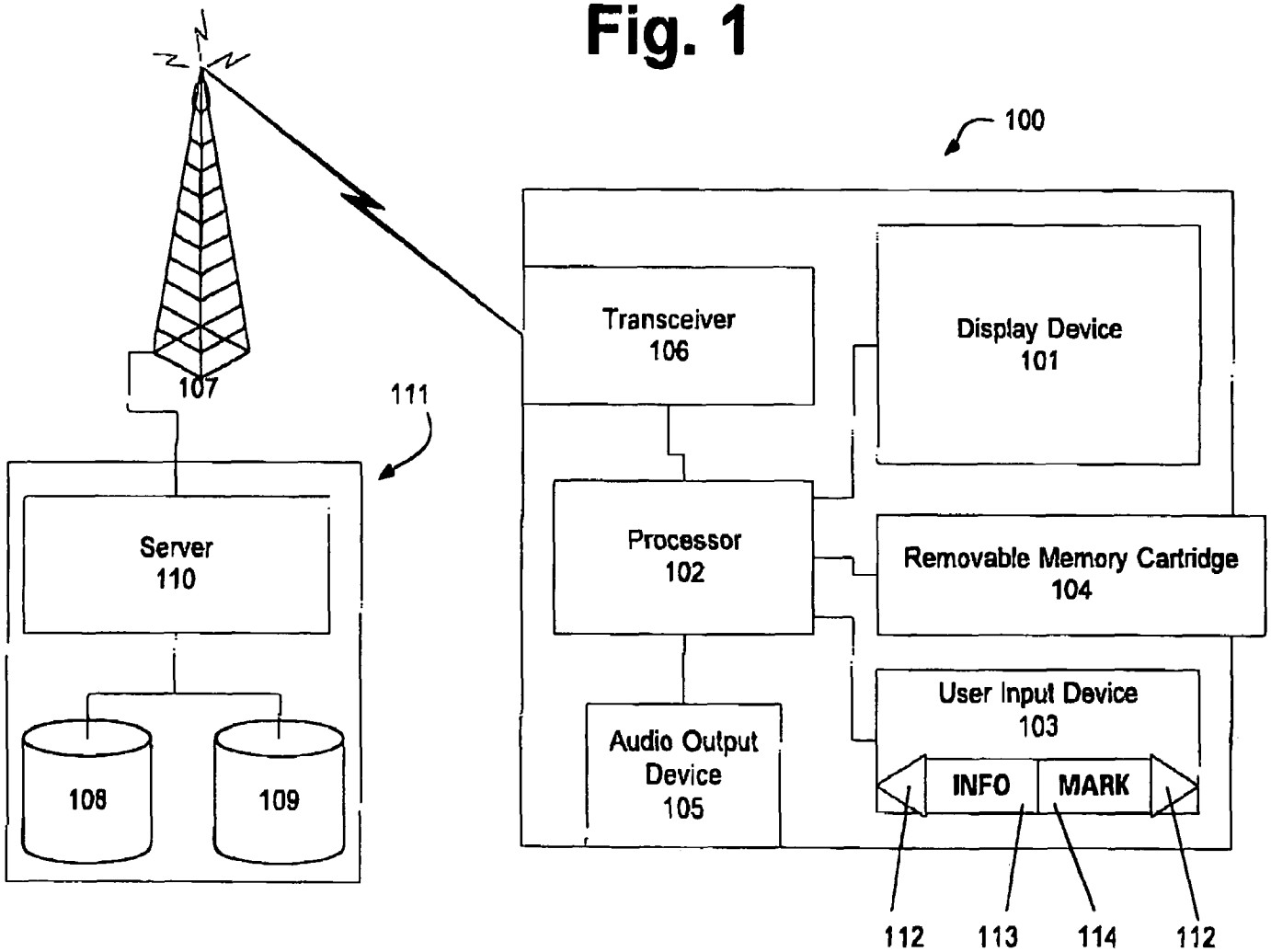
FIG. 1 is an illustration of a system for providing and recording contextual information about the musical works in a radio broadcast according to the principles of the present invention.

As shown in FIG. 1, a system according to the principles of the present invention includes a digital radio receiver 100 for receiving a digital data broadcast from a service provider 111. The digital data received by the receiver 100 includes music or other audio programming and contextual information about that programming.

The contextual information includes, but is not limited to, identification of the artists or performers involved in producing the music or audio programming being broadcast; the title of the work, the album on which it is included and a listing of other works on that album; cover art from the packaging of the commercial recording of the work; lyrics; notes about the work by the artists or songwriters; biographical information about the artists or songwriters; etc. For purposes of this discussion, recording of the work; lyrics; notes about the work by the artists or songwriters; biographical information about the artists or songwriters; etc. For purposes of this discussion, contextual information includes any information about or related to the artists or music or other audio programming being broadcast.

The broadcaster 111 has a music database 108 of the music or other audio programming available for broadcast. A second database 109 contains contextual information about the works in the music database 108. With a server 110, the broadcaster 111 can access the programming in database 108 and the related contextual information in database 109 to prepare a coordinated transmission of programming and contextual information.

In order to simultaneously broadcast the programming content and related contextual information, the broadcast should preferably be in digital format. The digital format readily provides the necessary capability for providing both content and contextual data simultaneously. A digital radio transmitter 107 of the service provider 111 transmits the coordinated signal to a digital transceiver 106.

The digital transceiver 106 is part of a radio unit 100 owned by a listener. The radio unit 100 may be a stationary unit, an automobile radio unit or a personal, portable radio unit.

As shown in FIG. 1, the radio unit 100 includes a processor 102 that receives the incoming broadcast from the transceiver 106. The processor 102 separates the audio signal carrying the music or other audio programming from the data signal carrying the contextual information.

The audio signal is provided to an audio output device 105. The audio output device 105 may be, for example, a speaker system, wireless headphones or a port into which headphones or other listening devices are plugged. Thus, the audio output device 105 is any device for transducing the audio signal of the digital broadcast into audible sound for the listener.

The contextual information carried by the data signal is displayed by the processor 102 on a display device 101. The display device 101 may be any device on which some or all of the contextual information can be displayed. However, the display device 101 is preferably a color or monochromatic liquid crystal or electroluminescent or LED display device capable of displaying both text and images. Contextual information images may include cover art or photos of the artists.

A user input device 103 is also connected to the processor 102. With the user input device 103, the listener can tune to different radio stations and input other instructions or data to the processor 102. The user input device 103 may be any device which can perform these functions. For example, the user input device 103 may include any of a dial or knob, a keypad, or a trackball or joystick used in conjunction with the display device 101.

Preferably, the user input device 103 will have several dedicated buttons. One such button 114 may be marked "STORE," "MARK" or "BOOKMARK." Another button 113 may be marked "INFO." Two other buttons 112 may indicate opposing arrows.

The following is an example of how a user may operate the radio 100 according to the present invention. To begin, a listener may use the arrow keys 112 to tune the transceiver 106 over the range of radio frequencies to receive a particular radio broadcast. The range of frequencies may be displayed on the display device 101 along with an indication of the frequency currently being received.

If the user hears a particular musical work about which he or she desires more information, the INFO button 113 is pressed. In response, the processor 102 displays the contextual information associated with that musical work on the display device 101. The listener may use, for example, the arrow keys 112 to navigate through the available contextual information.

If the user wishes to store the contextual information for later retrieval, e.g. the user wishes to purchase a recording of the music being broadcast, the user presses the MARK key 114. In response, some or all of the contextual information is saved by the processor 102 to the removable memory cartridge 104. The processor can then retrieve and display the information stored in the cartridge 104 when the user wishes to access that information.

Figure 2:
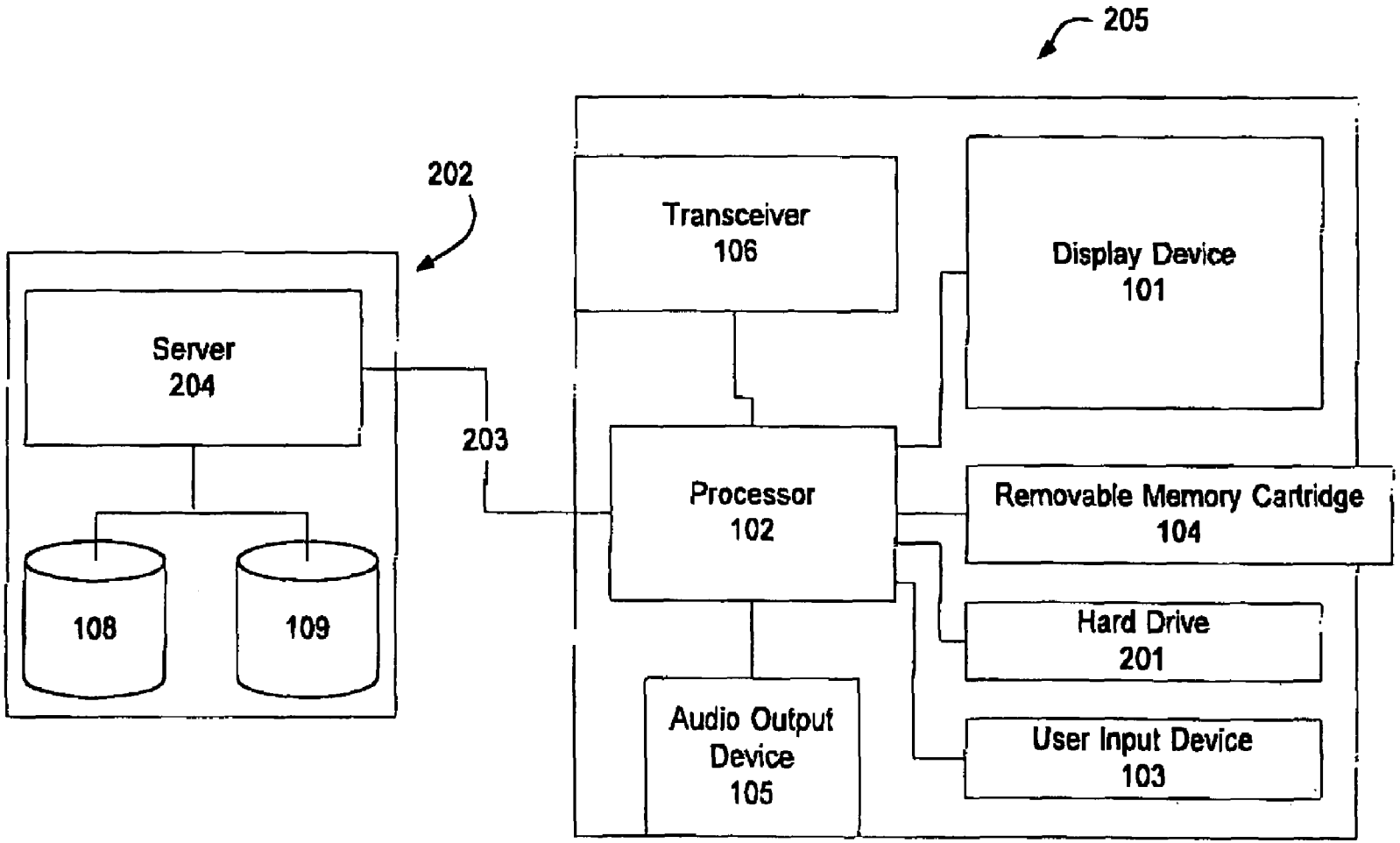
FIG. 2 is an illustration of system for allowing listeners to become better acquainted with musical works identified in a radio broadcast and for facilitating the purchase of recordings of those works according to the principles of the present invention.

FIG. 2 illustrates another embodiment of a radio receiver 205 according to the present invention. The radio receiver 205 is a stationary receiver, e.g. a home stereo unit. Like the receiver 100 of FIG. 1, the receiver 205 of FIG. 2 has a processor 102, transceiver 106, display device 101, user input device 103, audio output device 105 and removable memory cartridge 104. These common elements perform the same functions as described in connection with the receiver 100 of FIG. 1.

An example of the use of the receiver 205 of FIG. 2 will now be given. If a listener had been in his or her car or using a personal or portable radio and had stored contextual information about a broadcast to a removable memory cartridge 104, that cartridge 104 could be inserted into the home stereo receiver 205. With the user input device 103, a listener could then access the information on the memory cartridge 104 and display the same on the display device 101.

The processor 102 of the receiver 205 in FIG. 2 is provided with a connection 203 to a service provider 202. The connection 203 may be, for example, a telephone line, in which case, the processor 102 would include a modem. The phone line 203 may be used to connect directly to a server 204 of the service provider 202. Alternatively, the connection 203 may be over a computer network such as the internet or a wireless phone connection.

With the contextual information received from the broadcaster 111, the processor 102 may identify to the server 204 those musical works in which the user is interested. The user may then download from the service provider 202, for example, additional contextual information about the work, a sample or copy of the work, a sample of other musical works on the same album, a sample of other musical works by the same artist or contextual information about other works by the same artist. Additional contextual information may include the price of a recording of the work.

This downloaded information may be stored on the removable memory cartridge 104 or on a hard drive 201. If the downloaded information includes a musical work or a sample of one or more musical works, and the downloaded information is stored to the removable memory cartridge 104, the cartridge 104 may be removed and inserted in another receiver according to the present invention, for example, a portable personal receiver. That second receiver may then access and play the musical samples.

Additionally, using the user input device 103, the user may transmit a signal to the service provider 202 indicating an order to purchase or rent a recording of an indicated musical work. The service provider 202 may have the requested recording shipped to the user. Payment may be by subscription or on credit.

Alternatively, the service provider 202 may download the purchased recording electronically to the hard drive 201. The user may then keep the recording in the receiver 205, or the receiver 205 may be interfaced with a recording device, e.g. a tape recorder, harddrive or flashmemory device or a writeable compact disc drive, to produce a physical recording of the purchased musical work.

The preceding description has been presented only to illustrate and describe the invention. It is not intended to be exhaustive or to limit the invention to any precise form disclosed. Many modifications and variations are possible in light of the above teaching.

For example, the digital radio broadcaster 111 and the music vendor 202 may be the same party. In such a case, rather than the wire connection 202, the processor 102 may transmit purchase orders and requests for additional contextual information wirelessly with the transceiver 106. In such an embodiment, the user might also be able to obtain a listing from the server 110 of the musical works available in database 108 and request a transmission of that particular work.

These preferred embodiments were chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A method of providing listeners with information about audio programming being digitally broadcast comprising:

combining a data signal carrying contextual information about said audio programming with an audio signal carrying said audio programming;

broadcasting said combined data and audio signals;

receiving said combined data and audio signals from a service provider with a receiver;

separating said data and audio signals;

transducing said audio signal into audible sound;

displaying said contextual information about said audio programming on a display device of said receiver;

storing at least a portion of said contextual information of said data signal onto a removable memory medium; and Transmitting a purchase signal to said provider indicating an order to purchase a recording of said broadcast audio programming that is indicated by said at least a portion of said contextual information being displayed substantially contemporaneously with said broadcast audio programming on said display device.

2. The method of claim 1, further comprising broadcasting said combined data and audio signals as a digital radio signal.

3. The method of claim 1, wherein said step of storing further includes storing said audio programming onto said removable memory medium.

4. The method of claim 1, wherein said service provider has said recording shipped to the user.

5. A receiver for receiving a broadcast signal which is an audio signal and a data signal combined, said data signal containing contextual information about audio programming carried by said audio signal, said receiver comprising:

a transceiver for receiving said broadcast signal;

a signal processor for separating said audio and data signals;

an audio output device for outputting said audio signal;

a memory cartridge for storing at least a portion of said contextual information of said data signal, wherein said memory cartridge is a removable memory cartridge;

a connection between said processor and a service provider over which at least a portion of said contextual information may be transmitted to identify particular audio programming to said service provider; and a user input device for controlling transmission of said contextual information over said connection to said service provider and for generating requests to be transmitted to said service provider to purchase a recording of said particular audio programming indicated by said at least a portion of said contextual information being displayed substantially contemporaneously with said broadcast signal on a display device.

6. The receiver of claim 5, said user input device further controlling said display of said contextual information on said display device.

7. The receiver of claim 5, said user input device further controlling said storage of contextual information in said memory cartridge and accessing stored contextual information in said memory cartridge.

8. The receiver of claim 5, further comprising a memory device for storing said audio programming and said contextual information received over said connection from said service provider.

9. The receiver of claim 5, wherein said connection to said service provider is a wireless connection.

10. The receiver of claim 5, wherein said removable memory cartridge stores said audio programming and said at least said portion of said contextual information of said data signal.

11. The receiver of claim 5, wherein a service provider transmits said broadcast signal, said service provider having said recording shipped to the user.

12. A method for receiving a broadcast signal which is an audio signal and a data signal combined, said data signal containing contextual information about audio programming carried by said audio signal, said method comprising:

receiving said broadcast signal from a service provider with a transceiver;

separating said audio and data signals with a signal processor;

outputting said audio signal;

storing at least a portion of said contextual information of said data signal in a removable memory cartridge; and transmitting a purchase signal to said provider indicating an order to purchase a recording of said audio programming that is indicated by said at least a portion of said contextual information being displayed substantially contemporaneously with said broadcast signal on a display device.

13. The method of claim 12, further comprising controlling said display of said contextual information on said display device with a user input device.

14. The method of claim 12, further comprising purchasing said recording of said audio programming by transmitting at least a portion of said contextual information to said service provider to identify said audio programming.

15. The method of claim 14, wherein said transmitting to said service provider is performed by wirelessly transmitting to said service provider.

16. The method of claim 12, further comprising:

transmitting at least a portion of said contextual information to a service provider to identify said audio programming; and receiving from said service provider additional contextual information for said audio programming.

17. The method of claim 12, wherein said step of storing further includes storing said audio programming in said removable memory cartridge.

18. The method of claim 12, wherein said service provider has said recording shipped to the user.

19. A receiver for receiving a broadcast signal which is an audio signal and a data signal combined, said data signal containing contextual information about audio programming carried by said audio signal, said receiver comprising:

means for receiving said broadcast signal;

means for separating said audio and data signals;

means for outputting said audio signal;

means for displaying said contextual information of said data signal;

means for storing at least a portion of said contextual information of said data signal, wherein said storing means is removable; and means for transmitting at least a portion of said contextual information to a service provider to purchase a recording of said audio programming indicated by said at least a portion of said contextual information being displayed substantially contemporaneously with said broadcast signal.

20. The receiver of claim 19, further comprising means for controlling said display of said contextual information on a display device.

21. The receiver of claim 19, further comprising means for storing at least a portion of said contextual information of said data signal.

22. The receiver of claim 19, wherein said storing means stores said audio programming and said at least said portion of said contextual information of said data signal.

23. The receiver of claim 19, wherein said service provider transmits said broadcast signal, said service provider having said recording shipped to the user.

* * * * *